US006890265B2

(12) United States Patent
Enlow

(10) Patent No.: US 6,890,265 B2
(45) Date of Patent: May 10, 2005

(54) REVERSE TAPER GRIP

(76) Inventor: James Bradley Enlow, 2204 Alta Dr., Manhattan, KS (US) 66502

( * ) Notice: Subject to any disclaimer, the term of this patent is extended or adjusted under 35 U.S.C. 154(b) by 0 days.

(21) Appl. No.: 10/601,395

(22) Filed: Jun. 23, 2003

(65) Prior Publication Data

US 2004/0259659 A1 Dec. 23, 2004

(51) Int. Cl.[7] ..... A63B 53/14
(52) U.S. Cl. ..... 473/201; 473/300
(58) Field of Search ..... 473/300–303, 473/201, 204, 549–552, 203, 568; D21/756; D8/DIG. 6, 7; 74/551.9; 81/489; 16/DIG. 18, 19, 12, 24, 421, 430; 280/821

(56) References Cited

U.S. PATENT DOCUMENTS 3,295,850 A * 1/1967 Garrity ..... 473/201
3,441,276 A * 4/1969 Garrity ..... 473/201
3,837,647 A 9/1974 Jacques
4,736,950 A * 4/1988 Doyle ..... 473/538
D356,616 S * 3/1995 Jacques ..... D21/756
5,813,920 A * 9/1998 Rife ..... 473/300
6,213,891 B1 4/2001 Moore
6,656,057 B2 * 12/2003 Manual et al. ..... 473/300

FOREIGN PATENT DOCUMENTS

JP 2001-46568 * 2/2001
WO WO-00/016858 * 3/2000

* cited by examiner

*Primary Examiner*—Stephen Blau
(74) *Attorney, Agent, or Firm*—Hovey Williams LLP

(57) ABSTRACT

A reverse taper grip (16, 16*a*) for attachment to an elongated golf club shaft (12) or other similar handle or the like is provided, the grip (16, 16*a*) being formed of resilient synthetic resin material and presenting an outer gripping surface (20, 20*a*) of reverse taper design along at least a portion of the grip (16, 16*a*). The grip (16, 16*a*) presents a moderate reverse taper angle, with the ratio of the greater thickness end (28, 28*a*) to the smaller thickness end (24, 24*a*) being from about 1.1–1.7.

12 Claims, 1 Drawing Sheet

REVERSE TAPER GRIP

BACKGROUND OF THE INVENTION

1. Field of the Invention

The present invention is broadly concerned with improved reverse taper grips adapted for attachment to an elongated shaft or handle such as a golf club shaft or a racket handle. More particularly, the invention pertains to such grips which are preferably formed as a unitary body using a resilient synthetic resin material (e.g., closed cell polyurethane) and having a relatively moderate reverse taper which facilitates gripping and use of a club or the like.

2. Description of the Prior Art

Golf clubs and other recreational items such as tennis, handball and squash rackets typically include a grip adjacent the free end of the shaft or handle. Such grips may be a simple wrapping of tape or, in the case of golf clubs, an elongated rubber or rubber-like, radially expanded grip. Typically, conventional golf club grips are of tapered design with the largest diameter end of the grip adjacent the free end of the shaft remote from the club head. Similarly, racket handles have ben provided with contoured grips, see, e.g., U.S. Pat. No. 4,736,95.

Reverse taper grips have also been provided in the past, in the context of golf clubs. U.S. Pat. No. 3,837,647 describes a golf club grip having a reverse taper (i.e., the smallest diameter end of the grip is adjacent the free end of the shaft). However, the '647 grip has a relatively large degree of taper along the length of the grip, which has been found to be less than optimum from the standpoint of grip and club control. U.S. Pat. No. 6,213,891 describes very long gripping bodies adapted for connection to a putter and designed to aid a golfer in establishing and maintaining an efficient putting stroke.

Despite these teachings in the prior art, the ideal in a golf club or similar grip has not been realized, particularly in reverse taper grips.

SUMMARY OF THE INVENTION

The present invention overcomes the problems outlined above and provides an improved reverse taper grip designed for attachment to a shaft or the like (as used herein "shaft" refers to any type of shaft, shank, handle or elongated member which needs to be properly gripped for use). The grips of the invention are in the form of elongated bodies formed of resilient synthetic resin material, and especially closed cell polyurethane. Each such body has a length of from about 4–14 inches, more preferably from about 6–10 inches, a small diameter outboard end and a large diameter inboard end. A generally axial bore extends from the inboard end to a point proximal to the outboard end and is configured for receiving a shaft with the free end of the latter adjacent the terminal point of the bore. An outer gripping surface is provided between the inboard and outboard ends, while the inner bore defines a shaft-engaging surface. The gripped body presents a thickness between the outer and inner surfaces which increases along the length of at least a part of the grip from a small thickness near the outboard end of the shaft to a greater thickness near the inboard end thereof. Preferably, the ratio of the greater thickness to the smaller thickness is from about 1.1–1.7.

The preferred polyurethane foam should have a density of from about 2.8–3.5 lbs/ft.$^3$, and an indentation force deflection of from about 30–85 lbs. In a preferred design, the grip also presents an elongated region of substantial constant thickness (typically having a length of from about 1–4 inches) extending from the greater thickness end of the tapered section of the grip towards the inboard end thereof. The ratio of the length of the tapered section to the length of the constant thickness region should be from about 2–12, and more preferably from about 4–7.

DETAILED DESCRIPTION OF THE PREFERRED EMBODIMENT

Figure 1:
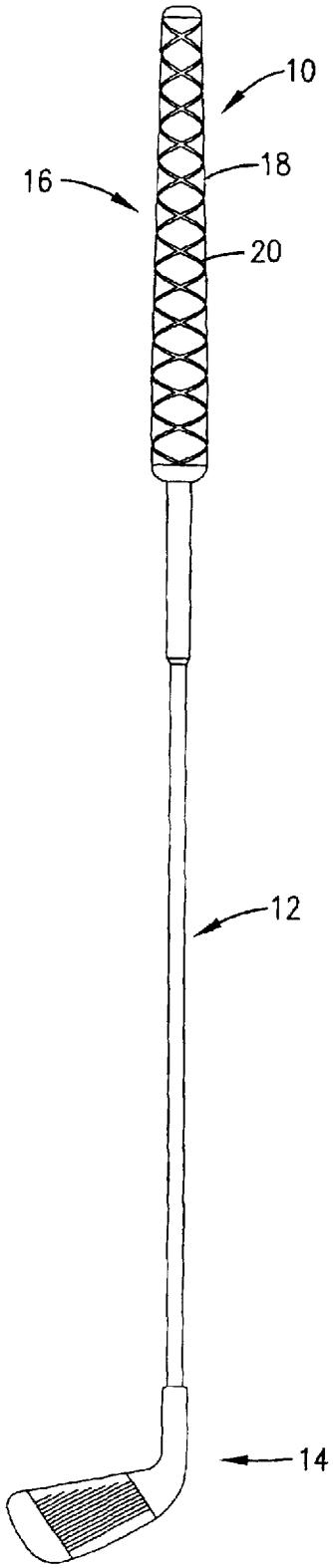
FIG. 1 is a side elevational view of a golf club in accordance with the invention, equipped with a preferred grip in accordance with the present invention.

Turning now to the drawing, a golf club 10 in accordance with the invention includes an elongated club shaft 12, a club head 14 secured to one end of the shaft 12, and a unitary synthetic resin grip 16 attached to the end of the shaft 12 remote from head 14. As broadly seen in FIG. 1, the grip 16 is of reverse taper design presenting a gripping surface 18 having a series of elongated, spiral recesses 20 to facilitate gripping by a user. It will be appreciated in this respect that the outer surface 18 may be fashioned in a number of ways for enhanced gripping, by roughening the surface 18 or providing different types of gripping recesses.

Figure 2:
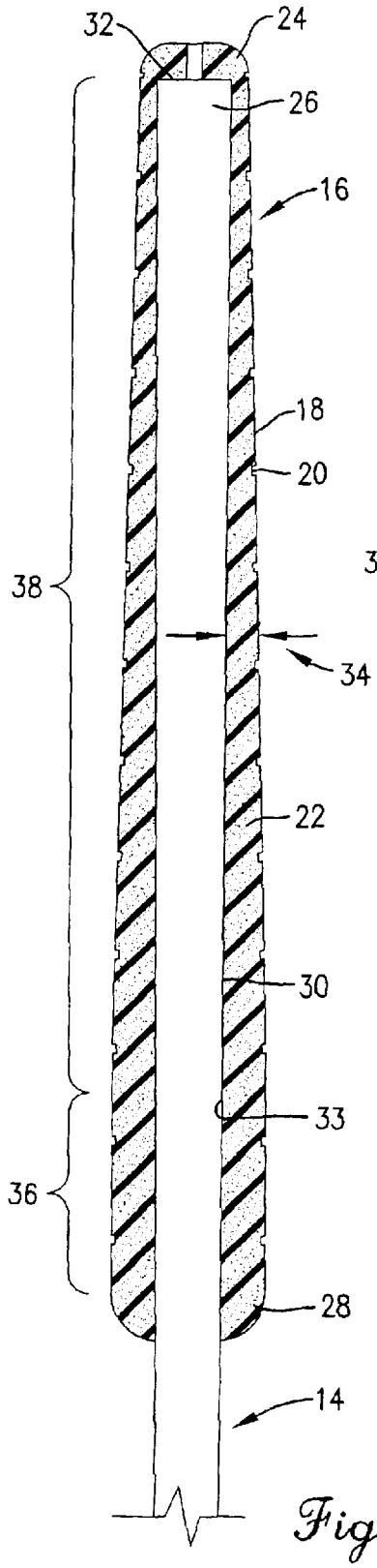
FIG. 2 is a partial sectional view of the club of FIG. 1, illustrating in detail the design of the grip.

FIG. 2 illustrates in more detail the preferred design of grip 16. In this connection, it will be seen that the grip 16 is in the form of an elongated, integrally formed body 22 with a small diameter end 24 adjacent the upper or free end 26 of shaft 14, and a large diameter end 28 closer to head 14. The grip also includes an axially extending bore 30 extending from end 28 to a terminal point 32 proximal to end 24. As shown, the bore 30 is designed to receive the free end of the shaft 14, and to this end the diameter of the bore at terminal point 32 is slightly larger than the diameter of the bore at the entrance thereof adjacent larger diameter end 28. The outer gripping surface 18 extends between the ends 24 and 28 whereas the bore 30 defines an inner shaft-engaging surface 33. The body 22 thus presents a variable thickness 34 between the surfaces 18 and 33

It will be observed that the FIG. 2 grip is of reverse taper design from end 26 and extending towards end 28. However, in this design, the inboard terminal section 36 of the grip 16 is of constant diameter and thickness. Thus, the reverse taper in this design extends from end 24 to the beginning of section 36, whereupon the grip has a constant thickness to end 28. Thus, the grip 16 presents a reverse taper surface section such that the thickness 34 of the body is at a minimum adjacent end 24 and progressively increases to the end of section 38 nearer the inboard end 28. In preferred forms, the length of the constant diameter section 36 should be from about 1–4 inches, and the ratio of the length of the reverse taper section 38 to the length of the constant thickness section 36 should be from about 2–12 and more preferably from about 4–7.

It has been determined that gripping efficiency and club use is maximized by provision of a relatively moderate reverse taper. Thus, the ratio of the greatest thickness of the body 22 at the inboard end of section 38 to the smallest thickness at end 24 should be from about 1.1–1.7, more preferably from about 1.2–1.6 and most preferably from about 1.3–1.5. Furthermore, forming the grip 16 from a material such as resilient closed cell polyurethane affords a number of advantages. Rubber materials previously used in club grips tend to be very slick and the golfer can thus lose control through perspiration on the hands. This problem is significantly lessened with the present grips.

Figure 3:
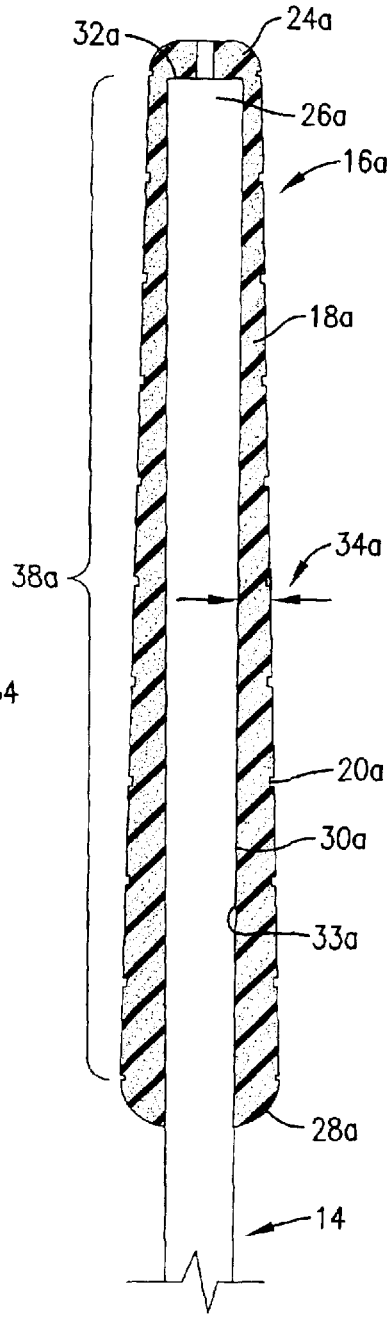
FIG. 3 is a partial sectional view similar to that of FIG. 2, but illustrating another grip design.

FIG. 3 illustrates a modified grip 16*a* which is commonly used on driver clubs. The grip 16*a* is identical in most respects with grip 16, except that it does not include the inboard constant thickness section 36. Thus, like reference numerals are used in connection with grip 16*a* as compared with grip 16, except with an "a" designation is employed. It will thus be seen that the grip 16*a* has a reverse taper surface 18*a* which extends essentially the full length of the grip from end 24*a* to end 28*a*, and in all other respects is identical with grip 16.

I claim:

1. A grip for attachment to a shaft having a free end, said grip comprising an elongated body formed of resilient synthetic resin material, said body having a length of from about 4–14 inches, a small diameter outboard end, a large diameter inboard end, a generally axial bore extending from said inboard end to a point proximal said outboard end for receiving said shaft with said free end thereof adjacent said outboard end, an outer gripping surface between said inboard and outboard ends, an inner shaft-engaging surface and a body thickness between said outer gripping and inner shaft-engaging surfaces, said outer surface presenting a reverse taper surface section between said outboard and inboard ends with said body thickness increasing along the length of said section from a smaller thickness nearer said outboard end to a greater thickness nearer said inboard end, the ratio of said greater thickness to said smaller thickness being from about 1.1 to 1.7 said grip having a diameter greater than the diameter of said shaft throughout the length of the grip, said grip presenting an elongated section of substantially constant diameter extending from said greater thickness end of said section towards said inboard end, said constant diameter region having a length of from about 1–4 inches, the ratio of the length of said reverse taper section to the length of said constant diameter section being from about 4–7, wherein said grip includes only two sections of substantial length those being said constant diameter section and said reverse section.

2. The grip of claim 1, said ratio being from about 1.20–1.60.

3. The grip of claim 2, said ratio being from about 1.3–1.5.

4. The grip of claim 1, said synthetic resin being polyurethane foam.

5. The grip of claim 1, said synthetic resin material having a density of from about 2.8–3.5 lbs/ft$^3$.

6. The grip of claim 1, said synthetic resin material having an Indentation Force Deflection from about 30–85 lbs.

7. A golf club comprising:

a club head and an elongated shaft secured to and extending from said head, said shaft presenting a free end remote from said head;

a grip as set form in claim 1 is installed on said shaft.

8. The golf club of claim 7, said ratio being from about 1.20–1.60.

9. The golf club of claim 8, said ratio being from about 1.3–1.5.

10. The golf club of claim 7, said synthetic resin being polyurethane foam.

11. The golf club of claim 7, said synthetic resin material having a density of from about 2.8–3.5 lbs/ft.$^3$.

12. The golf club of claim 7, said synthetic resin material having an Indentation Force Deflection from about 30–85 lbs.

* * * * *